United States Patent [19]

Jelling

[11] Patent Number: 4,701,070

[45] Date of Patent: Oct. 20, 1987

[54] METHOD OF POTHOLE REPAIR

[76] Inventor: Murray Jelling, 21 Spring Hill Rd., Roslyn Heights, N.Y. 11577

[21] Appl. No.: 893,736

[22] Filed: Aug. 6, 1986

[51] Int. Cl.[4] ..... E01C 7/35

[52] U.S. Cl. ..... 404/75; 156/94; 264/36; 405/265; 428/63

[58] Field of Search ..... 156/94; 264/36; 404/75; 405/216, 265; 427/136, 138; 428/63; 106/273 N

[56] References Cited

U.S. PATENT DOCUMENTS

| | | | |
|---|---|---|---|
| 2,438,318 | 3/1948 | Johnson | 106/273 N |
| 2,663,648 | 12/1953 | Jelling | 106/273 N |
| 2,706,688 | 4/1955 | Sommer et al. | 106/273 N |
| 2,737,509 | 3/1956 | Jelling | 260/405.5 PA |
| 2,772,179 | 11/1956 | Kalinowski et al. | 106/273 N |
| 2,954,301 | 9/1960 | Szukiewicz | 427/136 |
| 3,084,719 | 4/1963 | Wallace et al. | 405/265 X |
| 3,114,649 | 12/1963 | Katz | 106/273 N |
| 4,097,172 | 6/1978 | Burkhart | 404/75 |
| 4,194,023 | 3/1980 | Cushman et al. . | |
| 4,362,586 | 12/1982 | Uffner et al. . | |
| 4,545,699 | 10/1985 | Uffner et al. | 428/63 X |
| 4,561,900 | 12/1985 | Brouard et al. | 106/273 N X |

*Primary Examiner*—George A. Suchfield
*Attorney, Agent, or Firm*—Walter Katz

[57] ABSTRACT

An improved method of pothole repair is described wherein the bond between the pothole area and the asphaltic patch repair material is significantly improved. The method is characterized by applying an aqueous solution of a water soluble acid salt of a fatty amine, amido-amine polyamine or cyclic amine to the pothole area before adding the patch material to the cavity.

13 Claims, No Drawings

METHOD OF POTHOLE REPAIR

BACKGROUND OF THE INVENTION

1. Field of the Invention

This invention relates to the repair of potholes in roads and streets, and, more particularly, to an improved method of pothole repair where the bond between the deteriorated pothole area and the asphaltic patch material is substantially increased.

2. Description of the Prior Art

The prior art has been concerned mainly with bituminous compositions for admixture with mineral aggregates in the construction of asphalt pavements. See, for example, U.S. Pat. Nos. 2,737,509; 4,194,023; and 4,362,586. These compositions generally are inadequate, or have not been successfully used for pothole repair, where a strong bond is required between the pothole area and the asphaltic patch material.

The deficiency of the presently used method of pothole repair is the inadequate bonding of the repair mixture to the pothole cavity. This results in the repair mixture dislodging from the pothole after time. To solve this problem, it has been suggested, e.g. by Burkhart, in the U.S. Pat. No. 4,097,172, to apply a solution of a thermoplastic polymeric resin to the repair area so that the bond between the patch and the adjacent area is reinforced and made more secure. The method is unsuitable because of processing difficulties and expense.

Accordingly, the object of the present invention is to provide a new and improved method of pothole repair where the bond between the deteriorated area and the asphaltic patch material is significantly increased.

SUMMARY OF THE INVENTION

What is provided herein is a novel and improved method of pothole repair, characterized particularly by the step of applying an aqueous solution of a water soluble acid salt of a fatty amine, amido-amine, polyamine or cyclic amine compound to the deteriorated pavement area before placing the asphaltic patch material in its cavity. Thereby a strong bond is formed in situ between the thus-treated deteriorated paved areas and the patch material, and the patch is made permanent. In the preferred form of the invention, the aqueous solution includes the water soluble acid reacted with an alkyldiamine.

DETAILED DESCRIPTION OF THE INVENTION

In accordance with the present invention, there is provided an improved method of pothole repair. The method is based on the use of an aqueous solution of a water soluble acid salt of a fatty amine, amido-amine, polyamine or cyclic amine compound, which is applied to the inner surfaces of the pothole prior to filling it with asphaltic concrete. Thereupon a strong bond is achieved between the pothole surfaces and the filling, enabling the patch to be a permanent one. The improved results achieved herein are obtained in dry or wet weather conditions, even if there is an accumulation of water in the pothole, at cold or hot temperatures, with cold or hot asphaltic concrete mix, and irrespective of the particular bituminous compositions employed in the patch material. In all cases tested herein, the bond formed between the walls of the pothole area and the patching material was of a higher strength with the aqueous solution of the invention applied thereto than without it.

The compounds used herein are available commercially. For example, the acid salts of the fatty acid amido-amines, used herein in preparing the aqueous solution of the present invention may be made from among those compounds described by Jelling in U.S. Pat. No. 2,737,509, whose teachings are hereby incorporated by reference. These compounds have the general formula:

$$RCO—NR'—A—NR''_2$$

wherein RCO— is an acyl radical of $C_{12}$ to $C_{20}$ fatty acids; A is an alkylene group containing 2 to 6 carbon atoms; R' represents a hydrogen atom or an alkyl group containing 1 to 4 carbon atoms; and R'' represents hydrogen or an alkyl group containing 1 to 4 carbon atoms. In the above general formula the two R'' groups may be either the same or different radicals.

Accordingly, acid salts of unsubstituted and mono- and dialkylaminoalkylamides of the above formula are particularly useful herein.

Typical compounds that come within the scope of the above formula and are useful in accordance with the present invention include:

$$C_{17}H_{33}CONHCH_2CH_2N(CH_3)_2$$

which is N-(2-dimethylaminoethyl)oleamide, $C_{17}H_{33}CONHCH_2CH_2CH_2N(CH_3)_2$ which is N-(3-dimethylaminopropyl)oleamide; and $C_{11}H_{23}CONHCH_2CH_2CH_2N(C_2H_5)_2$ which is N-(3-diethylaminopropyl)lauramide.

Such compounds are available commercially from the Carbstab Corp., a division of Morton Thiokol Corp., Cinninati, Ohio, under the trademarks PAVE® 100, PAVE® 192 and PAVE-BOND® products.

Also useful are the acid salts of unsubstituted and mono- and dialkylaminoalkylamines wherein an alkyl radical replaces an acyl radical in the general formula above. A typical compound is Duomeen T made by Armak Co., which is a fatty aminopropylamine.

Also useful herein are long chain organic amines, such as fatty amines, preferably those which are liquids, such as oleylamine, $C_{18}H_{35}NH_2$ which is prepared as the acid solution thereof; fatty polyamines, such as are prepared from a fatty acid and an alkylenediamine, dialkylenetriamine, trialkylenetetramine, tetraalkylenepentamine, and pentaalkylenehexamine, which has the formula:

$$RCONHCH_2CH_2NHCH_2CH_2NHCH_2CH_2NHCH_2CH_2NHCH_2CH_2NH_2$$

where RCO— is as previously defined.

The fatty amines from waste bottoms from the production of polyamines, e.g., hexamethylenediamine, bishexamethylenetriamine and N-ethylhexamethylenediamine, also may be used in aqueous acid solution in this invention.

Similarly, the fatty amines derived from cyclic amines, e.g., N-aminoethylpiperazine, are alternative embodiments for use in preparing the aqueous bonding solution of the invention.

Other components optionally may be included in the aqueous bonding solution, e.g., anti-freeze additives, to prevent freezing while in use under extreme winter conditions.

The desired acid salt solution is prepared by mixing the amine compound, e.g., PAVE 100 or PAVE 192, with a water soluble carboxylic acid, e.g., acetic acid, any water soluble inorganic acid, e.g., hydrochloric acid, and water. Generally the aqueous solution contains about 0.1 to 10 wt.% of the acid salt, although this percentage can vary.

The invention now will be illustrated by reference to the following specific working examples thereof.

EXAMPLE 1

An aqueous bonding solution was prepared from the components given below by adding constituent 2 to 3, heating to 120° F.; then heating ingredient 1° to 120° F., and adding to the mixture of 2 and 3 with vigorous stirring.

| | wt. % |
|---|---|
| 1. PAVE 100 | −3.0 |
| 2. Acetic Acid | −0.6 |
| 3. Water | −96.4 |
| | 100.0% |

The aqueous bonding solution thus prepared was applied by swabbing to wet and dry artificial potholes in a laboratory feasibility study. Asphaltic patch materials then were added using hot and cold patch materials. The effectiveness of bonding of the pothole area to the patch material was measured in a pull test by tensile testing, and compared to control tests without application of the solution. Thereafter field trials of over 200 actual potholes were carried out. These potholes were repaired by application of the aqueous bonding solutions whose formula are given above. Later these potholes were found to be in excellent condition, even 24 months later after filling, whereas untreated potholes had deteriorated badly.

EXAMPLE 2

The aqueous bonding solution composition given below was prepaared and tested as in Example 1, with similar excellent results.

| | wt. % |
|---|---|
| 1. PAVE 100 or PAVE 192 | −3.0 |
| 2. Hydrochloric Acid (37%) | −0.6 |
| 3. Water | −96.4 |
| | 100.0% |

EXAMPLE 3

The tests of Example 1 are repeated with other fatty amido-amines, polyamines, amines made from waste bottoms from the production of polyamines, and fatty amines derives from cyclic amines to provide significantly improved pothole repair as compared to untreated potholes.

Although the invention has been described with particular reference to certain embodiments thereof, it will be understood that changes and modifications may be made which are within the skill of the art. Accordingly, it is intended to be bound only by the appendent claims, in which.

What is claimed is:

1. In the method of patch repairing deteriorated paved areas by the addition of asphaltic patch material, the step which comprises applying an aqueous solution of a water soluble acid salt of a compound selected from a fatty amine, amido-amine, polyamine or cyclic amine to the deteriorated pavement area before placing the patch material in the cavity of the deteriorated area, thereby forming a strong bond in situ between the thus-treated deteriorated paved area and the patch material.

2. The method according to claim 1 wherein said water soluble acid salt is formed from a water soluble carboxylic acid or water soluble inorganic acid.

3. The method according to claim 1 wherein said acid salt is the acetic acid salt.

4. The method according to claim 1 wherein said acid salt comprises about 0.1–10% by weight of said solution.

5. The method according to claim 1 wherein said deteriorated pavement area is dry or wet.

6. The method according to claim 1 further including the step of adding the patch to the cavity using cold patch or hot patch materials.

7. The method according to claim 1 wherein said aqueous solution is a water soluble acid salt of a compound having the general formula:

$$RCO—NR'—A—NR''_2$$

wherein RCO— is an acyl radical of $C_{12}$ to $C_{20}$ fatty acids; A is an alkylene group containing 2 to 6 carbon atoms; R′ represents a hydrogen atoms or an alkyl group containing 1 to 4 carbon atoms; and R″ represent hydrogen or an alkyl group containing 1 to 4 carbon atoms, which may be the same or different radicals.

8. The method according to claim 1 wherein said aqueous solution is a water soluble acid salt of a compound is a fatty amine or diamine.

9. The method according to claim 1 wherein said aqueous solution is a water soluble acid salt of a compound is a fatty acid polyamine.

10. The method according to claim 8 wherein the fatty amines are made from waste bottoms from the production of polyamines or cyclic amines.

11. The method according to claim 1 wherein an antifreeze component is included in said solution.

12. The method according to claim 1 wherein said compound is the water soluble acid salt of a fatty acid reacted with an alkyldiamine.

13. The method according to claim 1 wherein said water soluble acid salt is the hydrochloric acid salt.

* * * * *